United States Patent [19]

Wellman

[11] 4,454,929

[45] Jun. 19, 1984

[54] SAWBUCK

[76] Inventor: David Wellman, Star Route Box 227, Copper Center, Ak. 99573

[21] Appl. No.: 507,986

[22] Filed: Jun. 27, 1983

[51] Int. Cl.[3] ..... B27B 21/00; A47B 37/00

[52] U.S. Cl. ..... 182/154; 182/181; 182/225; 269/296; 269/901

[58] Field of Search ..... 182/153, 154, 225, 152; 269/901, 296

[56] References Cited

U.S. PATENT DOCUMENTS

| | | | |
|---|---|---|---|
| Re. 26,354 | 2/1968 | Usher | 182/152 |
| 162,799 | 5/1875 | Collins | 269/158 |
| 1,620,061 | 3/1927 | Blair | 182/225 |
| 3,034,546 | 5/1962 | Parsons | 182/153 |
| 4,133,412 | 1/1979 | Hildebrandt | 182/154 |
| 4,325,543 | 4/1982 | York | 269/296 |

*Primary Examiner*—Reinaldo P. Machado

*Attorney, Agent, or Firm*—Michael J. Tavella

[57] ABSTRACT

A folding sawbuck is disclosed that combines a cross frame design with integral vertical members, allowing a large quantity of logs or other wood to be cut into firewood at one time. The use of independant support assemblies, secure by horizontal members, provides an obstruction free cutting path that gives fast and safe cuts under all types of conditions, with all types of wood. The sawbuck is designed to be folded compactly for storage, and then opened for use with a minimum of difficulty. Two different embodiments of the invention are disclosed, each design using a different means for forming the "X"-frame portion of the main support assemblies. The invention is designed as a kit, with all parts pre-cut for easy assembly, or it can be manufactured fully assembled. The sawbuck can be constructed from either wood, metal or plastics.

12 Claims, 9 Drawing Figures

SAWBUCK

BACKGROUND OF THE INVENTION

This invention relates to sawbucks, and more particularly to folding, portable sawbucks.

There are several designs of portable sawbucks in the prior art. U.S. Pat. No. 3,034,546 to Parsons shows one type of sawbuck which can be folded for portability. This type of sawbuck has an X-frame construction, in which the logs are placed for cutting. Patent No. 162,799 to Collins, is another version of the X-frame design. The Collins patent also incorporates a hook device which is used to hold the logs in place while cutting them. This unit cannot fold up and is not as portable as Parsons. Both of these designs have one inherent problem: they are limited in the amount of wood that they can carry at any time. Collins is further limited by a central rod which limits the saw travel through the wood.

One design has recently emerged which purports to overcome the problems experienced in the previous designs. U.S. Pat. No. 4,325,543 to York overcomes the capacity problems of the previous patent designs by providing vertical posts which allow a large amount of wood to be held for cutting. This design also allows a somewhat safer cut, as the cross member which tie the assembly together are somewhat more removed from the line of cut then in the previous designs. However, the York design has severe limitations, most notably, the use of the closely spaced vertical members that are intended as a guide for the saw. It is recognized that a chain saw is an inexact tool, and frequent encounters with the guide members are envisioned along with the attendant damage to the sawbuck. Another problem with this vertical design is that it is not portable, nor can it be folded for ease of storage.

BRIEF DESCRIPTION OF THE INVENTION the general objective of the present invention is to solve the problem of cutting a large volume of logs at one time, while providing a unit which can be folded for storage and portability. Another objective of the present invention is to provide a sawbuck which can be produced in kit form, allowing it to be shipped disassembled, to be later assembled by the buyer.

The invention comprises a series of support assemblies which are connected together by three horizontal members. The support assemblies are fashioned to allow the invention to be either folded up for storage and carrying or opened for use by using three pivots in each support assembly, which allow the support members comprising the assembly to pivot freely into the appropriate positions. In the preferred embodiment, each assembly consists of two primary cross members which are bolted at their centers to form an X-frame configuration. The bolts are set so as to allow the cross members to pivot around their respective connection points. The lower ends of the cross members are cut so as to allow flat contact with the ground, thereby providing firm support.

A vertical support member is also bolted to each of the cross members in a manner which allows it also to pivot around its connecting bolt.

Horizontal members are attached to all of the assemblies to secure the entire unit together and to provide overall lateral strength for the unit. One horizontal member is attached to the bottom portion of each cross member in the assembly. A third horizontal member is attached to the top of one set of cross members. This third horizontal member functions additionally as a convenient handle for carrying the unit when folded. Support bracket means are provided to hold the bottom ends of the vertical members. These brackets lock the support assemblies into place for use.

The combination of x-brace cross members, pivoting vertical members, and upper and lower horizontal members allows the unit to be folded for carrying or storage, while at the same time permitting a large volume of wood to be cut without rods or other support members protruding into the cutting space.

BRIEF DESCRIPTION OF THE DRAWINGS

The accompanying drawings illustrate the various embodiments of the invention, of which.

DESCRIPTION OF THE PREFERRED EMBODIMENT

Figure 1:
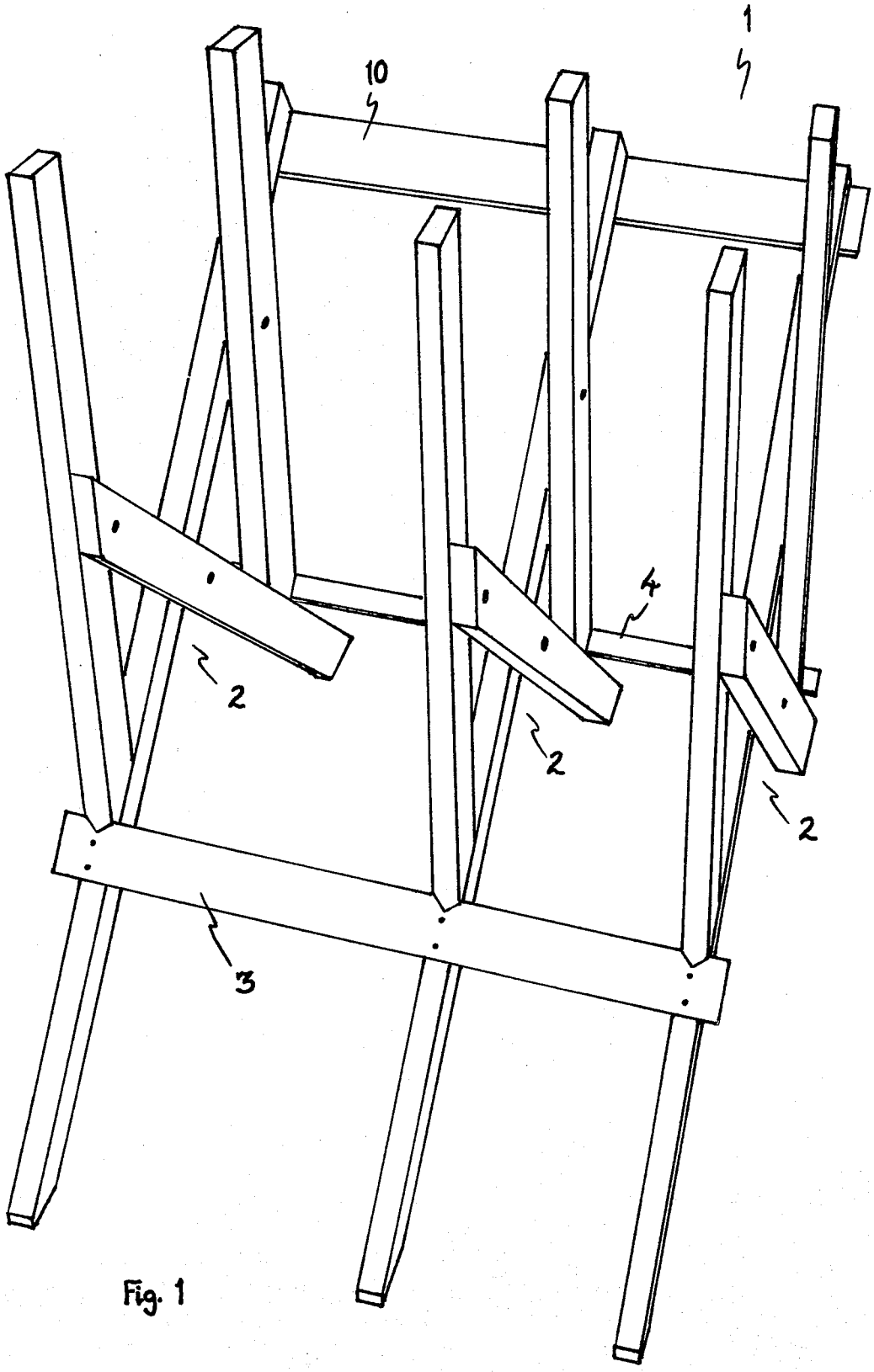
FIG. 1 is a perspective view of the preferred embodiment of the invention.

Referring now to the drawings, and more particularly to FIG. 1, the improved sawbuck 1 consists of a series of support assemblies 2 connected by two horizonal members 3 and 4, located near the lower ends of the support assemblies 2, and a third horizontal member 10, which is fastened to the top portion of each support assembly.

Figure 2:
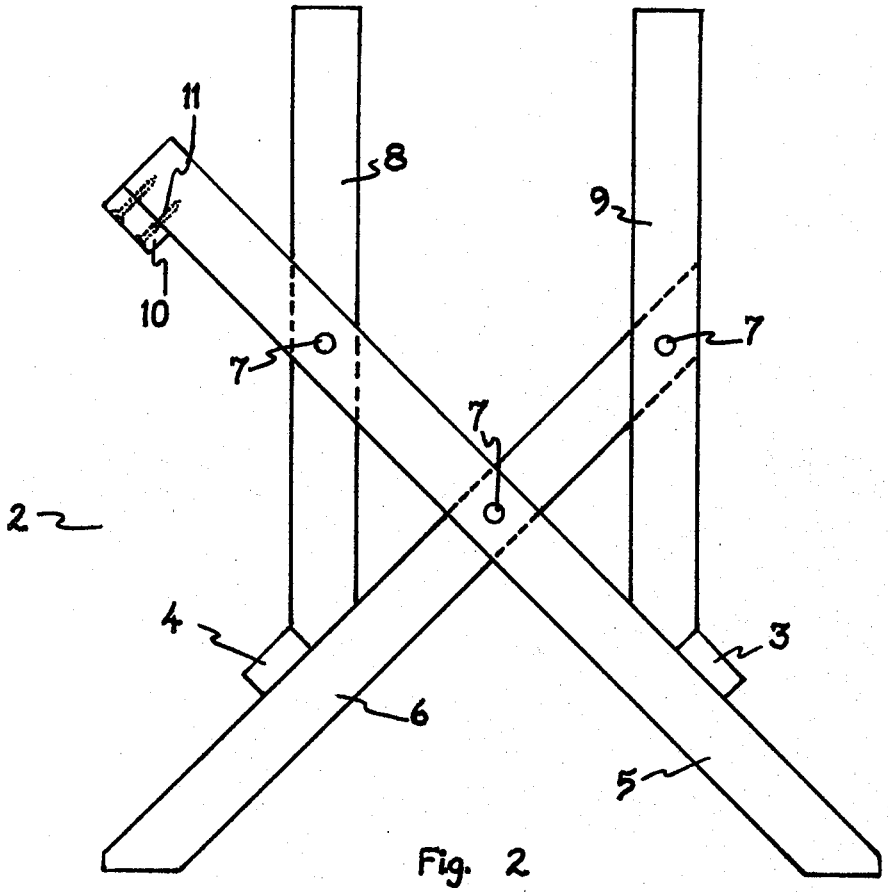
FIG. 2 is an elevation view of a support assembly of the preferred embodiment.

FIG. 2 is an elevation view of one support assembly 2. All other support assemblies in the device are constructed in the same manner. Each support assembly consists of a first cross member 5, which is connected to a second cross member 6 by pivot means 7. In the preferred embodiment, the pivot means 7 consists of a bolt, nut and washer assembly which will be further described hereinbelow. For the purpose described above, however, any type of similar pin construction, such as a rivet assembly (not shown) or other such device could be used.

The first cross member 5 has a vertical member 8 attached between the junction of the cross members 5 and 6, and the upper end of the first cross member 5. The vertical support member 8 is attached to the first cross member 5 by similar pivot means 7. A second vertical support member 9 is attached to the second cross member 6 by pivot means 7, as before. The point of connection of this vertical support member 9 is at the upper end of the second cross member 6.

As shown in FIG. 2, a first horizontal member 3 and a second horizontal member 4 are connected to the cross members 5 and 6 respectively.

The lower horizontal members 3 and 4 are further provided with support bracket means 12 (see FIG. 3) or other support bracket means 15 (see FIG. 5) to allow the ends of the vertical support members 13 or 14, which are pre-cut, to fit into the support bracket means, thereby locking the assembly into place. While the support bracket means, in the preferred embodiment, are attached to and formed in the horizontal members, the support bracket means can also be attached to the crossmembers independantly from the horizontal members. This allows greater latitude in the location of the horizontal members.

A third horizontal member 10 is fastened to the the first cross member 5, at the top end of the cross member 5. The third horizontal member 10 helps to secure the support assemblies together, and provides additional lateral strength.

Three support assemblies ae used to make up the sawbuck in the preferred embodiment. All of the support assemblies are connected to the horizontal members, which provide necessary structural support. In the preferred embodiment, the horizontal members are attached to the support assemblies by means of two widely spaced fasteners 11 such as wood screws or similar devices.

Figure 3:
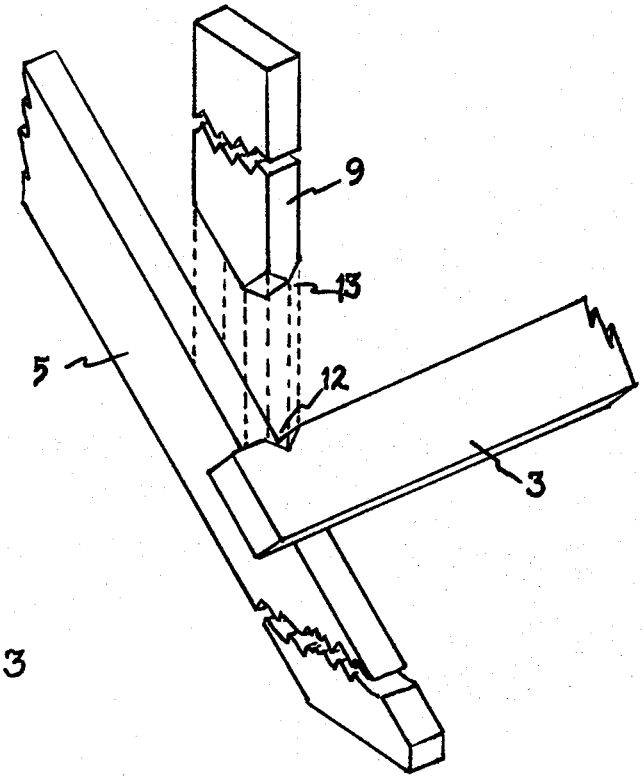
FIG. 3 is a detail of the vertical support member support bracket means of the preferred embodiment.

In the preferred embodiment, the pivot means 7 (described above) consist of a bolt assembly. The bolt assembly consists of a $\frac{3}{8}''\times 2\frac{1}{2}''$ bolt, a $\frac{3}{8}''$ flat washer, the first joined member, a second $\frac{3}{8}''$ flat washer, the second joined member, a third $\frac{3}{8}''$ flat washer, and a $\frac{3}{8}''$ nylon lined nut. The holes in the joined members that receive the bolt heads and nuts are counter sunk to prevent any inadvertent contact of the metallic bolt assemblies with a chain saw blade of other cutting instrument. Referring now to FIG. 3, the details of the support bracket means are shown. Support bracket means 12 are provided in horizontal members 3 and 4 (only horizontal member 3 is shown), to secure the lower end 13 of each vertical support member 8 and 9. In the preferred embodiment, the support bracket means are notches, cut into the horizontal members 3 and 4. A support bracket 12 is required at each location where the vertical support members 8 and 9 contact the horizontal members 3 and 4 of the sawbuck.

Figure 4:
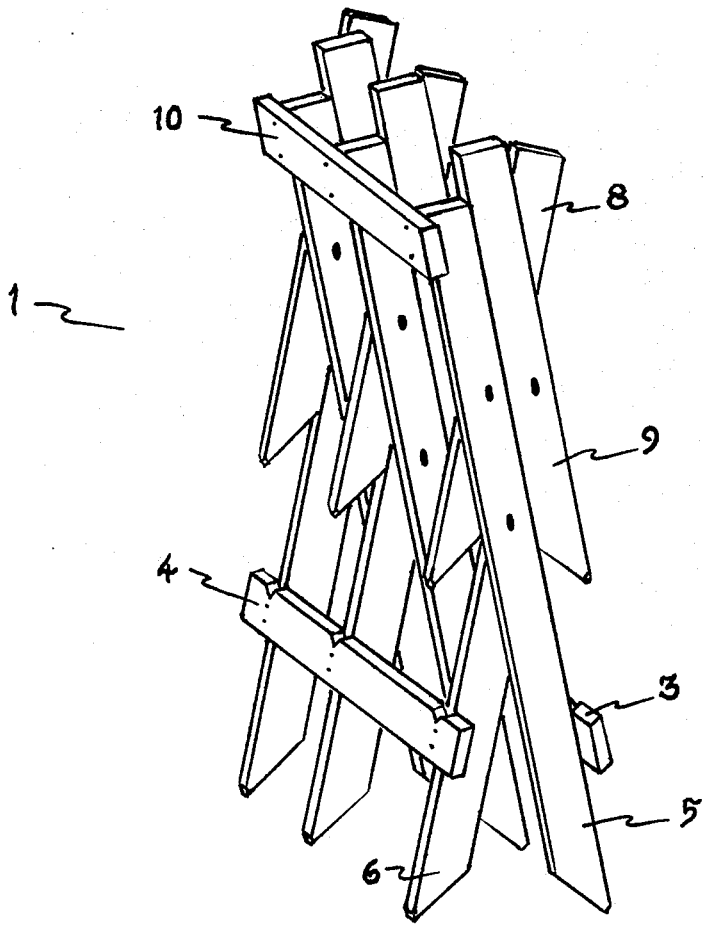
FIG. 4 is a perspective view of the preferred embodiment of the invention when folded.

FIG. 4 shows the sawbuck in its folded position. As shown, the sawbuck is folded by collapsing the cross members together. In this process, the vertical support members are freed from the support bracket means, and pivot so that they are parallel to and adjacent to the opposite cross members. The legs of the sawbuck are spaced far enough apart so that, when folded, the sawbuck is free standing.

The sawbuck is opened for use in the opposite manner. The cross members are pivoted until the vertical support members extend and engage the support bracket means in the horizontal members. Moderate resistance at the pivot points keeps the vertical support members in position so that the sawbuck opens smoothly. In the preferred embodiment, this resistance is provided by tightening the nuts in the bolt assemblies to a torque that provides the necessary friction.

Figure 5:
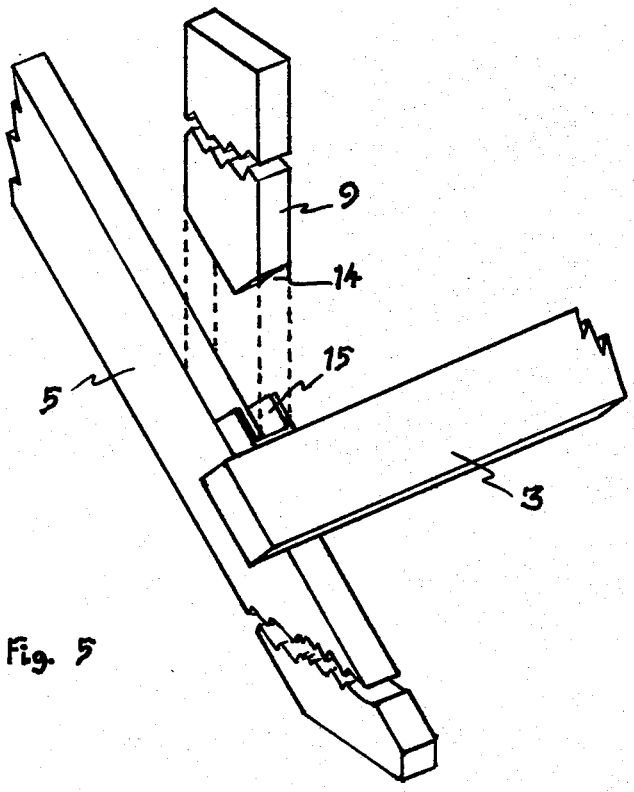
FIG. 5 is a detail of a second type of vertical support member support bracket means.

FIG. 5 shows another form of support bracket means. This second form is a bracket 15, attached to the lower horizontal member 3 or 4, in which the lower end 14 of the vertical member is seated. These brackets are fastened to the horizontal members with wood screws or other similar fasteners. One advantage of the bracket method is that it eliminates the need to cut pointed ends on the vertical members and V-shaped notches in the lower horizontal members. Again, the position of the support bracket means is not limited to the horizontal members. Auxilliary means can be provided to attach the support bracket means independently of the horizontal members thereby allowing the horizontal members to be located elsewhere on the invention. However, the support notch, as shown in FIG. 3, is the preferred method.

Figure 6:
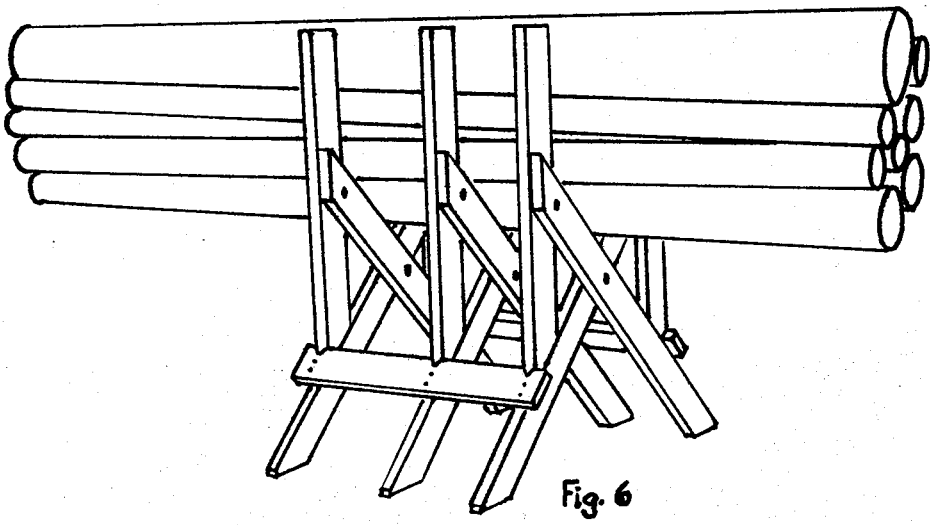
FIG. 6 is a view of the sawbuck when loaded with logs.

FIG. 6 illustrates how wood is stacked on the sawbuck to provide maximum utilization. When cutting long sections of wood, the ends of the logs are removed first. Additional cuts are then made alternately on opposite ends of the logs to keep the load balanced, with each cut being made closer toward the center of the sawbuck. The unequal spacing of the support assemblies, evident in FIG. 6, allows for the convenient cutting of logs into comnon stove-sized lengths, with cuts down the exact center of the sawbuck being facilitated. Other spacing arrangements of the support assemblies are possible.

Figure 7:
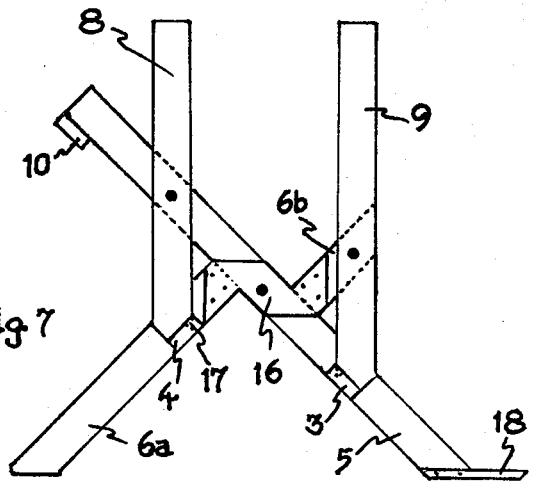
FIG. 7 is an elavation view of a support assembly of a second embodiment.
Figure 8:
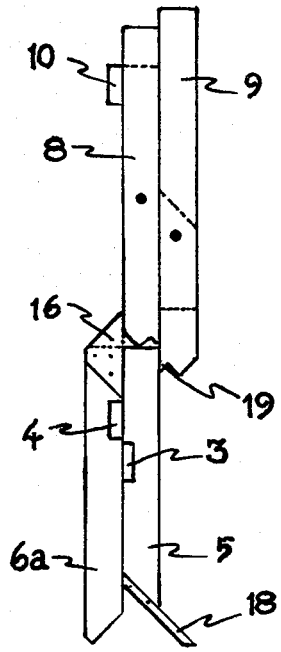
FIG. 8 is an elevation view of the second embodiment when folded.
Figure 9:
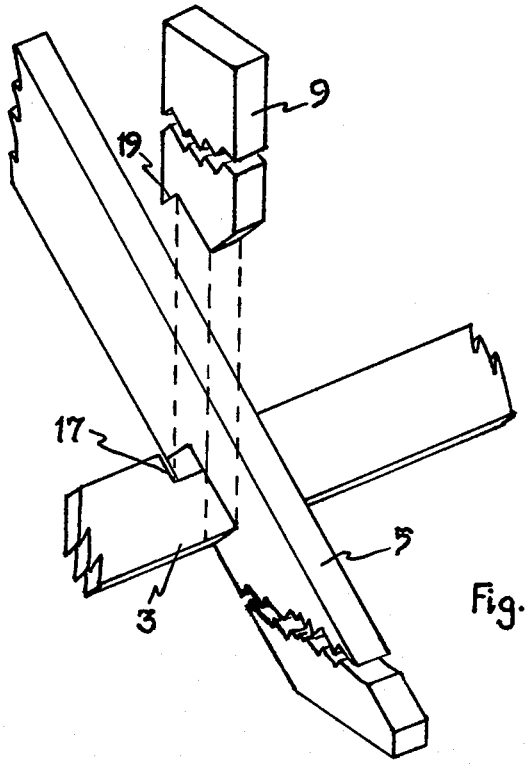
FIG. 9 details a third type of vertucal support member support bracket means, shown in the context of the second embodiment.

Another embodiment of the invention is shown in FIGS. 7, 8 and 9. The second embodiment uses a bracket to form the "X" frame portions of each support assembly. In this second embodiment, the lower horizontal members 3 and 4 are shown in different positions. A different type of support bracket means is also disclosed which is used to secure the lower ends of the vertical members. In this embodiment, the crossmembers 5 and 6 within one support assembly, lie in a common plane. The vertical members 8 and 9 are also in a common plane, different from that of the crossmembers. This is in contrast to the preferred embodiment, wherein one vertical member and the opposite crossmember occupy a common plane, different from that occupied by the other vertical member and crossmember.

Referring now to FIG. 7, a bracet means 16 is attached to the crossmember 5 by pivot means. The portion of the bracket means 16 which contacts the crossmember 5 is flat so that the bracket means 16 is allowed to pivot freely around the crossmember 5. The pivot means is similar to that in the preferred embodiment described above. This second embodiment utilizes two crossmembers in place of the single crossmember 6, used in the preferred embodiment. The two crossmember parts, *6a* and *6b*, are fastened to the bracket means 16 so that their ends lie flush against the crossmember 5 when the sawbuck is in the open position. The crossmember parts *6a* and *6b* are fastened to the bracket means 16 with wood screws or similar fasteners.

FIG. 8 shows the second embodiment in a folded position. As is shown in the drawing, this embodiment of the sawbuck can be folded flat as compared with the preferred embodiment (see FIG. 4). A support bar 18 is provided to keep the invention balanced in the folded position. The support bar is made of metal or a similar rigid material. The suport bar is attached to the lower portion of crossmember 5 by means of wood screws or similar fasteners.

FIG. 9 shows one type of vertical support member support bracket means that is used in the second embodiment. Unlike the preferred embodiment, the vertical support members are offset from the pivot plane of either crossmember. The second embodiment places the horizontal member 3 in a recess provided in crossmember 5, and horizontal member 4 in a similar recess in crossmember 6a. Support bracket means 17 are provided in the horizontal members 3 and 4 (only 3 is shown). In this embodiment, the support bracket meanas is a notch cut into the horizontal member. Other types of support brackets can be fashioned to perform the same function independantly of the horizontal member, and the discussion above is not meant to limit the scope of the invention. The lower end 19, of each vertical support member 8 and 9 is cut so as to allow it to seat in the support bracket means 17.

The sawbuck is made from wood in the preferred embodiment. Other materials such as metal or certain types of plastics could be used as well. For example, aluminum or steel members could be assembled with bolts. Other types of fabricated members can be used (although these are not illustrated) which conform to the general design and principal use of the device.

The design of this sawbuck allows it to hold a large quantity of wood. As there are no rods or other obstructions in the path of the sawblade, cutting completely through a quantity of wood presents minimal hazard to the structure of the sawbuck itself.

This sawbuck is designed to be packaged in kit form, with all the pieces pre-cut for assembly. The sawbuck is also designed for ease of manufacturing. The metal designs are especially suited for large scale fabrication in either kit form, or fully assembled.

It should be understood that the present disclosure is for illustration only and that this invention includes all modifications and equilvalents which fall within the scope of the appended claims.

I claim:

1. A portable sawbuck comprising:

(a) a plurality of support assemblies, each support assembly having a first cross member, a second cross member fixedly attached to the first crossmember by pivot means where they cross, one end of each of the crossmembers being formed to lie flat against the ground when in the upright, fully opened position;

(b) each support assembly also having a first vertical support member attached to the first cross member by pivot means, and a second vertical support member attached to the second cross member by pivot means, both pivot means being located where the vertical support members connect to each cross member;

(c) a first horizontal member being fixedly attached to the lower portion of each first cross member so as to connect the plurality of support assemblies together;

(d) a second horizontal member being fixedly attached to the lower portions of the second cross members of the support assemblies substantially in the same manner as the first horizontal member, and for the same purpose as the first horizontal member;

(e) support bracket means located so as to secure the lower end of each vertical member when the support assemblies are fully opened, in such a manner that the vertical members are plumb vertically when their lower ends are engaged in the support bracket means;

(f) a third horizontal member, being fixedly attached to the upper end of each first cross member, connecting the plurality of support assemblies so as to provide additional strength.

2. The sawbuck as described in claim 1, wherein the support assemblies and horizontal members are made of wood.

3. The saw buck as described in claim 1, wherein the pivot means are bolts.

4. The sawbuck as described in claim 1, wherein the support assemblies and horizontal members are made of metal.

5. The sawbuck as described in claim 1, wherein the pivot means are rivets.

6. The sawbuck as described in claim 1, wherein the support assemblies and horizontal members are made of plastic.

7. A portable sawbuck comprising:

(a) A plurality of support assemblies, each support assembly having a first crossmember, a bracket means pivotably attached to said first crossmember, a second cross member fixedly attached to said bracket means, a third crossmember also fixedly attached to the bracket means so that the second crossmember and the third crossmember lie parallel to each other on opposite sides of the first crossmember, thereby forming an "x" configuration when the sawbuck is placed in the open position, and also such that all the crossmembers in the support assembly occupy a common plane, and also such that the second and third crossmembers are offset from each other so that when the support assembly is closed, the second and third crossmembers lie parallel to the first crossmember, and when the support assembly is opened, the second and third crossmembers are generally perpendicular to the first crossmember;

(b) Each support assembly also having a first vertical member pivotably attached to the first crossmember;

(c) Each support assembly also having a second vertical member pivotably attached to the third crossmember;

(d) a first horizontal support member fixedly attached to the lower portion of each support assembly's first crossmember;

(e) a second horizontal support member fixedly attached to the lower portion of the second crossmember of each support assembly;

(f) a third horizontal member, fixedly attached to the first crossmember of each support assembly, the third horizontal member being located at the top end of each support assembly's first crossmember;

(g) support bracket means located so as to secure the lower end of each vertical member when the support assemblies are fully opened, in such a manner that the vertical members are plumb vertically when their lower ends are engaged in the support bracket means.

8. The sawbuck as described in claim 7, wherein the support assemblies and horizontal members are made of wood.

9. The saw buck as described in claim 7, wherein the pivot means are bolts.

10. The sawbuck as described in claim 7, wherein the support assemblies and horizontal members are made of metal.

11. The sawbuck as described in claim 7, wherein the pivot means are rivets.

12. The sawbuck as described in claim 7, wherein the support assemblies and horizontal members are made of plastic.

* * * * *